US009573409B2

(12) United States Patent
Huddart

(10) Patent No.: US 9,573,409 B2
(45) Date of Patent: Feb. 21, 2017

(54) DRAWING TOOL

(76) Inventor: Alastair Huddart, Ludlow (GB)

( * ) Notice: Subject to any disclaimer, the term of this patent is extended or adjusted under 35 U.S.C. 154(b) by 452 days.

(21) Appl. No.: 13/699,652

(22) PCT Filed: May 26, 2011

(86) PCT No.: PCT/GB2011/050998

§ 371 (c)(1),
(2), (4) Date: Nov. 23, 2012

(87) PCT Pub. No.: WO2011/148185

PCT Pub. Date: Dec. 1, 2011

(65) Prior Publication Data

US 2013/0064594 A1 Mar. 14, 2013

(30) Foreign Application Priority Data

May 27, 2010 (GB) ..... 1008897.9
May 28, 2010 (GB) ..... 1008973.8

(51) Int. Cl.
*B43K 19/00* (2006.01)
*B43K 23/016* (2006.01)
*B44D 3/22* (2006.01)

(52) U.S. Cl.
CPC ..... *B43K 19/00* (2013.01); *B43K 23/016* (2013.01); *B44D 3/22* (2013.01)

(58) Field of Classification Search
CPC ..... B43K 23/00; B43K 23/004; B43K 23/016; B43K 23/06; B43K 19/00; B44D 3/22; B41K 1/04; B41K 1/08; B41K 1/56
USPC ..... 401/88; D18/15; 410/48, 131
See application file for complete search history.

(56) References Cited

U.S. PATENT DOCUMENTS 258,254 A * 5/1882 Schevenell ..... B43K 23/004 401/48
737,102 A * 8/1903 Holt ..... 401/88
2,176,160 A * 10/1939 Uhl, Jr. ..... B41K 1/04 101/381
2,316,138 A 4/1943 Irving
(Continued)

FOREIGN PATENT DOCUMENTS

DE 202004004653 U1 5/2004
DE 202008002815 U1 5/2008
(Continued)

*Primary Examiner* — Jennifer C Chiang
*Assistant Examiner* — Bradley Oliver
(74) *Attorney, Agent, or Firm* — David Guerra

(57) ABSTRACT

The present invention provides a drawing tool for an artist, draughtsman or hobbyist etc., the drawing tool comprising a handle and a retaining means disposed on the handle. The retaining means being adapted to releasably retain an elongate drawing material, such as a graphite lead, in an orientation substantially transverse to the axis of the handle. In use, manipulation of the handle and selective application of pressure to the elongate drawing material enables the drawing material to be applied to a drawing surface to thereby control the degree of shading on the drawing surface. The hand tool has particular application to reliably rendering gradients when shading with graphite and chalk etc. To be accompanied, when published, by FIG. 1 of the drawings, deposit varying thicknesses of graphite on the paper to modify the gradient of the shading.

19 Claims, 7 Drawing Sheets

(56) References Cited

U.S. PATENT DOCUMENTS 2,899,895 A * 8/1959 Tannery ..... B41K 1/04
101/381

FOREIGN PATENT DOCUMENTS

| | | | |
|---|---|---|---|
| FR | 937940 | A | 8/1948 |
| LU | 28336 | A | 5/1953 |

* cited by examiner

END VIEW

SIDE VIEW

BOTTOM VIEW TOP VIEW (IN USE)

DRAWING TOOL

CROSS-REFERENCE TO RELATED APPLICATIONS

This application is an U.S. national phase application under 35 U.S.C. §371 based upon co-pending International Application No. PCT/GB2011/050998 filed on May 26, 2011. Additionally, this U.S. national phase application claims the benefit of priority of co-pending International Application No. PCT/GB2011/050998 filed on May 26, 2011, Great Britain Application No. 1008973.8 filed on May 28, 2011 and Great Britain Application No. 1008897.8 filed on May 27, 2010. The entire disclosures of the prior applications are incorporated herein by reference. The international application was published on Dec. 1, 2011 under Publication No. WO 2011/148185 A1.

BACKGROUND OF THE INVENTION

Field of the Invention

The present invention relates to implements for artists and craftsmen, and particularly relates to a hand tool for holding drawing materials while drawing.

Description of the Prior Art

The use of graphite for drawing purposes is well known to artists and craftsmen, and is much the preferred drawing material for many modern artists. One reason for this is that graphite is relatively convenient to work with, while still producing aesthetically pleasing results of high artistic standing. Another reason for the popular use of graphite is that it is relatively cheaper compared to other artistic materials, such as water colours and oil paints etc.

Conventionally artists working in graphite tend to use graphite leads (i.e. elongate cylinders of pressed graphite) of varying thicknesses or natural charcoal sticks, which can be applied to a drawing surface, such as paper, either by way of a "sharpened" tip at the end of the graphite lead or by pressing the cylindrical body of the graphite lead against the paper and dragging it across the surface. In practice, both techniques are commonly used to create the drawing, the former technique to principally delineate detail within the drawing, while the latter technique can be used to fill larger areas and to produce gradient shading to give an apparent depth and realism to a drawing.

Although many artists tend to use graphite leads or charcoal sticks by simply holding them between their fingers, it can be difficult to hold and manipulate the leads/sticks, particularly when attempting to create gradient shading effects, as the artist must then place the body of the lead/stick against the paper and drag it across the surface. Moreover, since most graphite leads are typically quite thin, e.g. between 3 mm to 10 mm, they can be quite prone to snapping if too much pressure is applied to the body of the lead/stick, or otherwise, if it is held in an inappropriate manner.

To address some of these problems, the prior art provides an artists tool commonly referred to as a "clutch pencil holder", which is similar in function and operation to a conventional retractable pen or pencil. Therefore, the graphite lead is held within the cylindrical body of the holder, whereupon the lead can be extended by way of an actuating button at the distal end of the holder. The actuating button releases a gripping "clutch" at the proximal end of the holder, which thereby allows a tip of the graphite lead to be extended and exposed. The artist can then sharpen the tip (using a craft knife etc.) and commence drawing by using the holder in the manner of a conventional pen or pencil.

However, although such tools are useful to an artist, they only allow the graphite lead to be used to delineate detail in the drawing and to shade only relatively small areas via the sharpened tip, as it is not possible to make use of the body of the lead, along its full length, as the lead is enclosed within the holder. As a result, the use of these tools can be restrictive to an artist, as it may prevent the artist from achieving a particularly desired result. In many cases therefore, an artist may be forced to remove the graphite lead from the holder and to consequently hold the lead between their fingers, thereby potentially exposing him/her-self to some of the above problems. Moreover, if an artist desires to change the grade of the hardness or blackness of the graphite lead, he/she must again remove the lead from the holder and replace it with the required lead, which may be a fiddly and time consuming task.

SUMMARY OF THE INVENTION

Therefore, it is an object of the present invention to provide an improved and easy to use drawing tool that solves at least some of the above problems associated with using graphite, or similar drawing materials such as chalks etc.

According to an aspect of the present invention there is a provided a drawing tool, comprising:

- a handle; and
- a retaining means disposed on the handle and adapted to releasably retain an elongate drawing material in an orientation substantially transverse to the axis of the handle.

References herein to an "elongate drawing material" are to be taken to include, but are not intended to be limited to, a graphite lead, a graphite crayon, a pressed charcoal pencil, a natural charcoal stick, a chalk and a wax crayon. However, it is to be appreciated that the drawing material may also be any other suitable material that is capable of rendering, or otherwise laying down or depositing, a layer of material to produce a marking and/or shading effect on a drawing surface when applied to that surface, either in greyscale or colour.

By "drawing surface" we mean any surface to which the elongate drawing material may be applied and to which at least some of the drawing material consequently adheres. In the context of the present invention, a drawing surface is intended to preferably, but not exclusively, relate to paper, card, canvass or any other suitable artists media or substrate, irrespective of the grade or quality of the material used.

The drawing tool of the present invention is preferably a hand tool, in that it is intended to be used by the hand of an artist, craftsman, draughtsman or hobbyist etc. to create drawings in a desired drawing material, which most preferably is graphite.

The provision of a retaining means that is adapted to releasably retain an elongate drawing material in an orientation substantially transverse to the axis of the handle enables the tool to hold the elongate drawing material, such as a graphite lead, in a way which allows the full length of the lead to be placed against the drawing surface. In this way, large areas of the drawing surface, such as paper, can be then be shaded by manipulating the tool to drag, or push, the graphite lead across the surface of the paper. In particular, the tool of the present invention is suited for controlling the degree of shading on the drawing surface, and is particularly useful for producing gradient shading effects, as will be discussed in more detail below.

Hence, it will be appreciated that the present invention provides a significant advantage over the more traditional techniques of manually holding (i.e. by hand) a lead on its side, as the drawing tool may hold a graphite lead of a smaller diameter than can be practically held by hand. Moreover, it is found that through the use of a smaller diameter graphite lead a much smoother marking or shading of the drawing surface (e.g. paper) may be achieved, as the deposition of the particulate graphite layer 'penetrates' the surface of the paper more deeply, unlike with the use of larger diameter leads, as these generally have a greater contact area with the paper that prevents or hinders the graphite from 'penetrating' the surface as effectively as graphite deposited by smaller diameter leads. As a result, larger diameter leads tend to give rise to a coarser grain of shading (e.g. giving a mottled appearance of darker and lighter patches). Therefore, the present drawing tool is ideally suited for a 'life drawing' style of artistry, as it is able to reproduce the smooth textures required to depict the human form, without pronounced graininess or mottling.

In a preferred embodiment, the handle of the drawing tool is elongate and serves as the body of the tool. The artist grips the handle to manipulate the tool when drawing with the drawing material. Preferably, the handle is made from a rigid plastic or plastic material, but may also be made from a semi-rigid plastic or hardened rubber. In other embodiments, the handle may also be made from metal, and optionally coated in a rubberised plastic material, or the handle may even be made from wood.

However, the most preferred material for the handle is a rigid plastic, which may be either injected moulded or machined from a block of plastic, according to conventional manufacturing techniques. An advantage of using plastic is that the resulting tool is relatively cheap to manufacture, as compared to multi-component clutch pencil holders, and is also reasonably hardwearing. For ease of manufacture, the elongate handle is preferably substantially rectangular in shape, having thickness and width dimensions that are preferably significantly shorter than the length dimension of the handle.

However, it is to be understood that the handle may have any desired shape and/or cross-sectional form, and consequently the handle may be cylindrical, triangular, square or hexagonal in cross-section. In addition, the handle may be texturised or otherwise coated with a surface (e.g. rubberised) to enhance grip and to further facilitate manipulation of the tool. Moreover, the handle may have an ergonomic shape to permit ease of use and/or increase comfort for the artist during prolonged use of the tool.

In one embodiment, the handle is preferably planar, but in other embodiments, the handle may be non-planar.

The handle preferably defines an axis along the length of the handle, which in elongate and planar arrangements corresponds substantially to the longitudinal axis of the handle; while in non-planar arrangements may correspond to an axis that is substantially parallel to a tangent to the surface of the handle at a point along the length of the handle.

In preferred embodiments, the retaining means comprises a partially open bore having an axis substantially transverse to the axis of the handle. The bore is preferably disposed proximal to a first end of the handle, i.e. the end that is opposite to the end of the handle that the artist grips. Preferably, the bore is located at the edge of the first end of the handle, whereupon it is adapted to releasably retain the graphite lead. The bore is preferably cylindrical in cross-section and is sized to accommodate a graphite lead of specified diameter. The bore is open down one side, along its length, such that part of the outer wall (preferably around one third of the circumference) of the bore is preferably missing at the leading edge of the handle. Preferably, the open walled bore may be formed as part of an injection moulding process or alternatively it may be created by subsequent machining of the tool during fabrication.

During use, an elongate drawing material such as a graphite lead of appropriate diameter, is preferably inserted into the bore by way of a 'push-fit', whereupon it is held securely in placed via friction. When the graphite lead is fitted to the tool, the lead preferably projects/extends either side of the bore, transverse to the axis of the handle. The plastic of the handle (and hence retaining means) is sufficiently flexible, yet resilient, to enable the lead to be inserted without damaging or snapping the lead. Either, or both ends of the bore may be chamfered to further facilitate insertion of the graphite lead into the drawing tool.

The bore size (i.e. diameter) will depend on the size of the graphite lead to be used by the artist. Therefore, since in this embodiment the bore size is preferably fixed, it is intended that the artist will require a different tool for each lead size that he wishes to use. However, due to the relatively low production costs of the tool, this should not incur significant expense for the artist, and in many respects this may be quite convenient for him/her, as he/she may always have a tool 'pre-loaded' with the required lead ready for use at all times. It is envisaged that due to the relatively low production costs of the tool, an artist should be able to have several separate tools for different hardness of graphite or type of media etc. or even different colours of the same media.

It is to be appreciated that the bore may have any desired cross-sectional shape or form, depending on the nature of the graphite lead to be used. Therefore, in some instances, the hexagonal leads provided by many art shops and suppliers may be used with an embodiment of the tool having an hexagonal bore, while still enjoying all of the benefits of the present invention. In addition, the bore could be shaped to accommodate bespoke square or triangular cross-section drawing materials. However, it is to be appreciated that the most preferred arrangement is with the use of cylindrical leads, such that the lead may be rotated to present a 'fresh edge' when the current edge (face) becomes worn down during use.

When the graphite lead is fitted to the tool, a portion of the outer surface of the lead protrudes beyond the open walled part of the bore, along the length of the lead. Hence, the artist can then make use of the full length of the lead to affect shading, and in particular gradient shading, when applied to the surface of the paper. At some future time when the artist wishes to replace the lead, for example, due to the lead wearing down or to replace it with a different grade of lead (i.e. hardness or blackness) of the same diameter, he/she simply pushes the lead out of the bore and push-fits the replacement back into the tool.

In another preferred embodiment, the drawing tool of the present invention may also comprise a second retaining means disposed on the handle in spaced relation to the first retaining means. Preferably, the second retaining means is disposed proximal to a second end of the handle. Therefore, the first and second retaining means preferably reside at respective ends of the handle. The second retaining means is preferably adapted to releasably retain a second elongate drawing material, such as a graphite lead, in an orientation substantially transverse to the axis of the handle.

The second retaining means preferably comprises a partially open bore, having the same or different bore size to the first bore of the preceding embodiments. Hence, the first and second bores may be identical to accommodate the same sized graphite leads, or else may be of different sizes so that different sized leads can be fitted at the same time. Moreover, advantageously, the same tool can accommodate graphite leads of different grades of hardness or blackness, so that a 'soft lead' (e.g. 2B) can be fitted at one end of the tool, and a 'hard lead' (e.g. 4H) can be fitted at the other, so that the artist can readily swap between the leads by simply rotating the tool. In addition, the first and second bores may have different cross-sectional shapes so that, for example, both cylindrical and hexagonal leads can be used by the same tool.

The second bore preferably defines an axis that is substantially parallel to the axis of the first bore, which in turn is substantially transverse to the axis of the handle. Therefore, in the same manner as for the first bore, it is possible to mount a graphite lead that is orthogonal to the handle so that the full length of the lead can be applied to the surface of the paper, with both the first and second leads being substantially in the plane of the handle. In this way, the second graphite lead can be used to effect additional shading (optionally at a different grade of hardness or blackness) to that of the first graphite lead, with the combined shading of both leads being complementary to the aesthetic appeal of the finished drawing.

The second bore preferably operates in the same way as the first bore, and therefore, the graphite lead is simply 'push-fitted' into the bore and held via a friction fit. Should a replacement lead be subsequently required, the artist need only push the lead out of the second bore and insert a new one.

The following description of an example use of the drawing tool of the present invention applies equally to a tool having only a single bore as well as to a tool having two bores. Therefore, it is to be appreciated that a two-bore tool is operated in the same way as a one-bore tool, except that the artist has the option to rotate the tool to make use of another graphite lead of potentially different size, shape and/or grade of thickness/blackness.

During use, the artist grips the handle of the tool and may typically extend his/her index finger, so that the artist's finger rests on the graphite lead at some point along its length. To effect shading on the paper, the artists presses the body of the lead against the surface and drags, or pushes, the tool across the paper either in a linear or curved motion, or both, depending on the desired shading effect. However, as the lead is securely held by the tool at approximately its mid-point, and therefore is not being directly gripped by the artist, the artist is free to selectively position his/her finger at any point along the length of the lead to increase the downward pressure on the lead at that point, thereby producing an enhanced shading effect on the paper located under or near that point of the lead. Hence, the artist has much greater control over the degree of shading as the tool is dragged/pushed across the surface of the paper, which allows for better control of the gradient within the shading. As a result, many different kinds of gradient shading effects can be produced than otherwise would be possible if the artist were to simply hold the lead between their fingers, as the selective application of pressure enables the graphite to be deposited on the surface according to the pressure differential established along the length of the lead.

In embodiments having a second bore and hence potentially a second graphite lead, many different shading effects may be achieved. In particular, in 'life drawing' (e.g. relating to the portrayal and depiction of the human or animal form), the first graphite lead (in the first bore) may be used to depict the outer edge portion of the human form, quickly enabling a gradient shading/darkening to be drawn giving rise to a distinct sharp edge. However, a true depiction of the human form requires many varying areas of graduated shading, some needing gradual or softened edges so that the subtle shading of the body can be realistically rendered.

Hence, it is possible to make use of the second bore to accommodate another graphite lead, preferably a relatively shorter lead that may be 'prepared' by applying an abrasive paper (e.g. sandpaper) or a metal file etc. to both ends to produce a flattened overall U-shape. In this way, a shading effect may be achieved that is darkest in the middle and fades away to relatively lighter (or virtually imperceptible) tones at the edges—in other words, it produces a gradient having softened edges.

In another embodiment a disc shaped lead is preferably partially inserted in a retaining bore in the second end of the tool handle, and is most preferably secured by a friction fit. This bore is preferably orientated at substantially right angles to the elongated lead at the other end.

Again the drawing face of the protruding lead is preferably domed slightly to produce a graduated mark which is darker in the middle and has soft edges.

The inserted lead is preferably limited by a narrowing of the bore where it exits the top side of the handle. This opening enables the lead to be pushed out for changing, using a rod of slightly smaller diameter. In this embodiment the handle preferably has a bend next to the lead to orientate the diameter of the disc parallel to the drawing surface when in use.

It is found that index finger pressure over the lead can accurately control the tone of the mark.

This embodiment consistently enables the rapid build up of soft edged graduated areas of tone without the directional marks produced by conventional drawing tools, and is ideally suited for rendering, for example, the interior forms in Life Model Drawing etc.

Moreover, a further advantage of the tool is that the artist is also able to place at least one finger, or preferably a finger tip, directly on top of the part of the handle that comprises the first (or second) retaining means, which is found to give even better control of the tool as the artist can directly manipulate the direction and motion of that end of the handle when the tool is in use, and by selectively varying the magnitude of the pressure applied to that end of the handle, can accurately control the tone of the mark produced.

In addition, further effects (such as varying the width of the gradient shading) can also be achieved by twisting or tilting the handle of the tool as it is dragged across the surface of the paper, as again this action can vary the pressure along the length of the lead, which in turn alters the length of the lead in contact with the paper. In this way, the tool can be manipulated to selectively deposit varying thicknesses of graphite on the paper to modify the gradient of the shading and the tone of the colouration.

Thus, the drawing tool of the present invention provides artists and craftsman with significant advantages in terms of rendering complex and aesthetically pleasing shading effects, while remaining under the complete control of the artist and yet being easy to use.

The present invention also provides for a drawing kit comprising a drawing tool according to any of the embodiments of the invention, along with one or more elongate drawing materials selected from a graphite lead, a pressed charcoal pencil, a natural charcoal stick, a chalk, wax and a Conte crayon. Hence, it is envisaged that the tool may be offered for sale in kit form to artists and craftsmen, optionally with a set of leads of different grades of thickness and hardness.

It is be understood that although the preferred embodiments of the drawing tool comprise one or two retaining means each in the form of an open bore, any other suitable retaining means may alternatively be used in conjunction with the tool of the present invention. Hence, in other embodiments the retaining means may take the form of a clip or clamp, which optionally may be adjustable to accommodate different sizes of graphite lead in the same tool. However, to maintain low production costs and ease of use, a single-piece tool fabricated in plastic is the most preferred embodiment.

Moreover, it should also appreciated that even though the preferred embodiments of the invention have been described in terms of the use of graphite leads, any other suitable elongate drawing material may alternatively be used with the tool of present invention. Therefore, the tool also has application with chalks and wax crayons, with the bore(s) being sized appropriately to accommodate the chalks or crayons. Moreover, it is possible that the tool may be adapted to accommodate one each of a graphite lead and a chalk or crayon via differently sized bores. As a result, this would provide the artist with yet further options for rendering aesthetic creations, as many artists work in both graphite and chalk etc.

BRIEF DESCRIPTION OF THE DRAWINGS

Embodiments of the present invention will now be described in detail by way of example and with reference to the accompanying drawings in which.

DETAILED DESCRIPTION OF THE INVENTION

Figure 1:
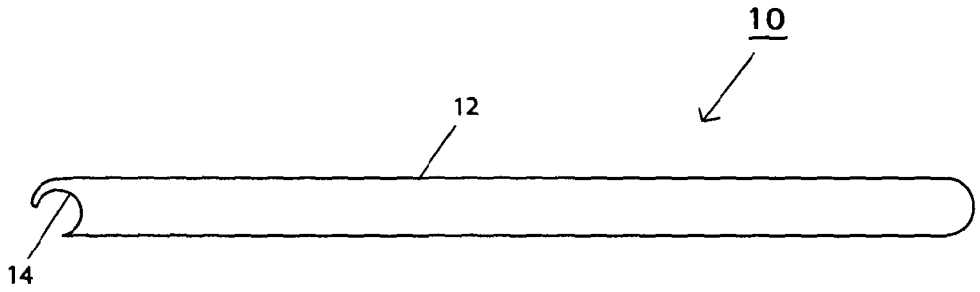
FIG. 1—shows a side view of a drawing tool according to a particularly preferred embodiment of the present invention.

Referring to FIG. 1, there is a shown a particularly preferred embodiment of a drawing tool 10 according to the present invention. The drawing tool 10 comprises an elongate handle 12 of rectangular cross-section. The handle 12 serves as the body of the tool 10 and is made from a rigid plastic. The plastic may be a transparent plastic or otherwise may be partially translucent or opaque. The tool 10 is approximately 12 cm long in length, and is approximately 1 cm in width by 0.5 cm in height. Although it is to be appreciated that any other suitable dimensions may be used.

In the example of FIG. 1, the tool 10 has been fabricated by an injection moulding process according to conventional techniques.

Figure 2:
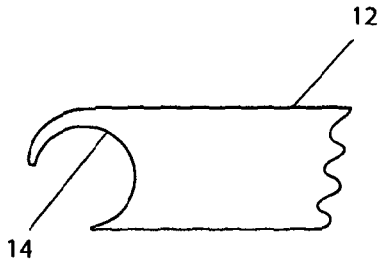
FIG. 2—shows a magnified view of a part of the drawing tool of FIG. 1, illustrating an example retaining means.

The handle 12 is substantially planar and defines a longitudinal axis that runs along the length of the handle 12. At the first end of the handle 12, there is located a retaining means comprising a partially open bore 14 having an axis substantially transverse to the axis of the handle 12. The bore 14 is formed as part of the injection moulding process, but can otherwise be machined later if necessary. As shown in FIG. 2, the bore 14 is approximately circular in cross-section and is sized to accommodate an elongate drawing material, such as a graphite lead, of a specified diameter.

Figure 3:
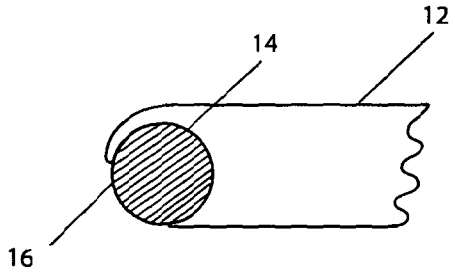
FIG. 3—shows the drawing tool of FIG. 2 ready for use, with an example elongate drawing material retained by the retaining means.

The bore 14 is open down one side, along its length, such that the outer wall of the bore is missing at the leading edge of the handle 12. The open part of the bore 14 therefore serves as an opening through which to receive a cylindrical graphite lead 16, by way of a 'push-fit' action, which securely holds the lead 16 in place via friction within the bore 14, as shown in FIG. 3. The diameter of the bore 14 is just sufficient to receive a graphite lead 16 of specific size and hold it in place, without damaging or snapping the lead.

Of course, it is to be appreciated that the bore size will depend on the size of the graphite lead to be used by the artist, and therefore different tools will be required for different graphite sizes. Typical graphite lead sizes for art purposes range from 3 mm to about 10 mm or more. Hence, the tools (and bore) can be sized appropriately as necessary.

Figure 4:
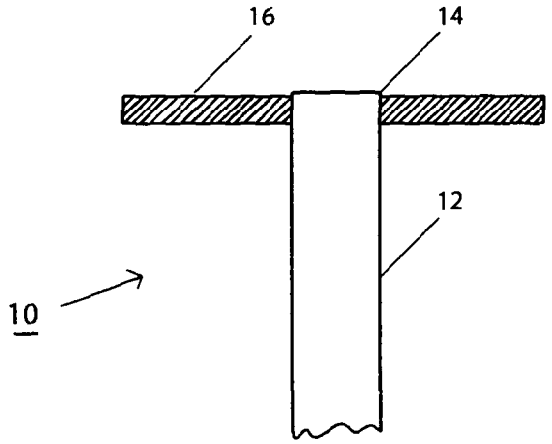
FIG. 4—shows a top plan view of the drawing tool of FIG. 1, ready for use, with an example elongate drawing material retained by the retaining means.

As shown in FIG. 3, when the graphite lead 16 is fitted to the tool 10, a portion of the outer surface of the lead protrudes beyond the open walled part of the bore 14, along the length of the lead, which extends in both directions either side of the bore 14 transversely to the axis of the handle 12 and along the axis of the bore 14 (as shown in FIG. 4). As a result, the artist can then make use of the full length of the lead to effect shading on a drawing surface, such as paper, when the lead is applied to the surface of the paper (not shown). In this way, potentially large areas of the paper can then be shaded by manipulating the tool 10 to drag the graphite lead 16 across the paper to produce gradient shading effects.

An advantage of using cylindrical leads is that when the current edge becomes worn, the lead may then be rotated within the bore to present a new edge (i.e. curved face) to the drawing surface. However, if at some future time the artist wishes to completely replace the graphite lead 16, for example due to all edges of the lead wearing down or to replace it with a different grade of lead (i.e. hardness or blackness) of the same diameter, he/she simply pushes the lead 16 out of the bore 14 and push-fits a replacement back into the tool 10.

Figure 5:
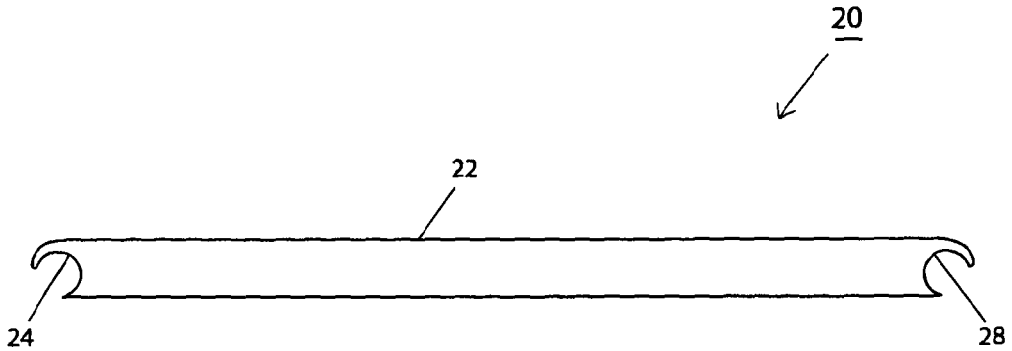
FIG. 5—shows a side view of a drawing tool according to a another preferred embodiment of the present invention, illustrating first and second retaining means.
Figure 6:
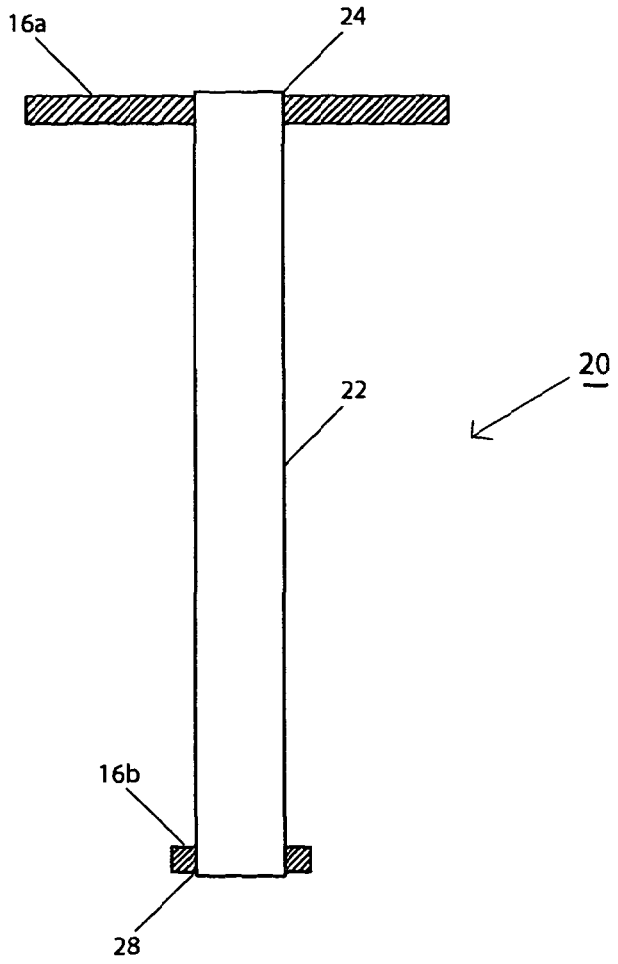
FIG. 6—shows a top plan view of the drawing tool of FIG. 5, ready for use, with example elongate drawing materials retained by the first and second retaining means.

Referring now to FIG. 5, there is shown another example of a drawing tool 20 of the present invention. However, in this example the tool 20 includes a second retaining means located at the opposite end of the handle 22 to that of the first retaining means. In this example, the first retaining means is identical to the bore 14 of the tool 10 of FIGS. 1 to 4, and therefore is adapted to receive graphite leads in the manner as described above. However, in the tool 20 of FIG. 5, the second retaining means comprises a partially open bore 28 that is sized to receive and hold a graphite lead 16*b* of a different size as to that of the first bore 24. Of course, it is to be appreciated that both bores 24 and 28 may be of the same size, depending on the particular tool.

The second bore 28 is the same in form (except internal diameter) to that of the first bore 24 and therefore it has an axis that is parallel to the axis of the first bore 24, which in turn requires that both bores have axes that are transverse to the axis of the handle 22.

Hence, it is possible to mount graphite leads 16*a*, 16*b* that are each orthogonal to the handle 22, so that the full length of each lead can be separately applied to the surface of the paper. As a result, the second graphite lead 16*b* can be used to effect additional shading (optionally at a different grade of hardness or blackness) to that of the first graphite lead 16*a*, with the combined shading of both leads being complementary to the aesthetic appeal of the finished drawing. The second graphite lead 16*b* is simply 'push-fitted' into the second bore 28, as in the manner of the first graphite lead 16*a*, and is held via a friction fit. Should a replacement lead be subsequently required, the artist need only push the lead 16*b* out of the second bore 28 and insert a new one.

The use of the drawing tool will now be described in respect of the tool of FIGS. 1 to 4. However, it is to be appreciated that a tool having two-bores is operated in much the same way as one having only a single bore, except that the artist has the option to rotate the tool to make use of another graphite lead of potentially different size and/or grade of thickness/blackness.

Figure 7:
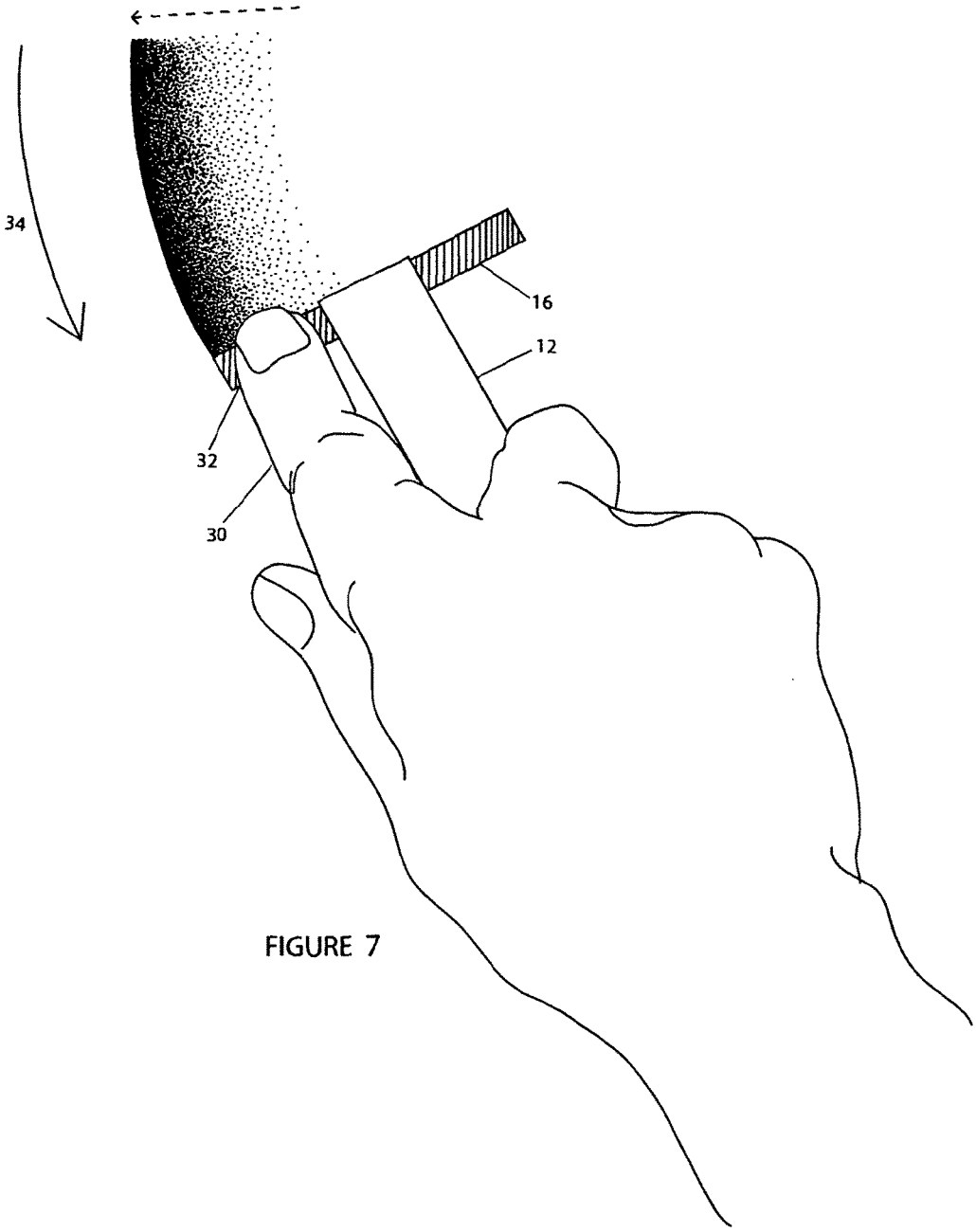
FIG. 7—illustrates an example use of the drawing tool of FIG. 1 by an artist.

During use, as shown in FIG. 7, the artist grips the handle 12 of the tool 10 and may typically extend his/her index finger 30, so that the artist's finger 30 rests on the graphite lead 16 at a point 32 along its length. To effect shading on the paper, the artist presses the body of the lead 16 against the surface and drags the tool 10 across the paper in a curved motion, as indicated by the arrow 34. (Of course, in practice the motion may be linear or a combination of curved and linear, as required).

As the lead 16 is securely held by the tool 10 at approximately its mid-point, and therefore is not being directly gripped by the artist, the artist is free to selectively position his/her finger 30 at any point 32 along the length of the lead 16 to increase the downward pressure on the lead at that point, thereby producing an enhanced shading effect (as indicated by the dashed arrow in FIG. 7) on the paper located under or near that point of the lead. Hence, the artist has much greater control over the degree of shading as the tool 10 is dragged across the surface of the paper, which allows for better control of the gradient within the shading.

As a result, many different kinds of gradient shading effects can be produced than otherwise would be possible if the artist were to simply hold the lead between their fingers, as this can be difficult to reliably control, while the selective application of pressure enables the graphite to be deposited on the surface according to the pressure differential established along the length of the lead 16.

Moreover, as the artist is also able to place at least one finger directly on top of the part of the handle 12 that comprises the bore 14, he/she can then directly manipulate the direction and motion of that end of the handle as the tool is dragged across the surface. In this way, the artist can reliably control both the motion of the tool and the pressure applied to the graphite lead 16, which enables him/her to achieve any desired shading shape and/or effect.

Figure 8:
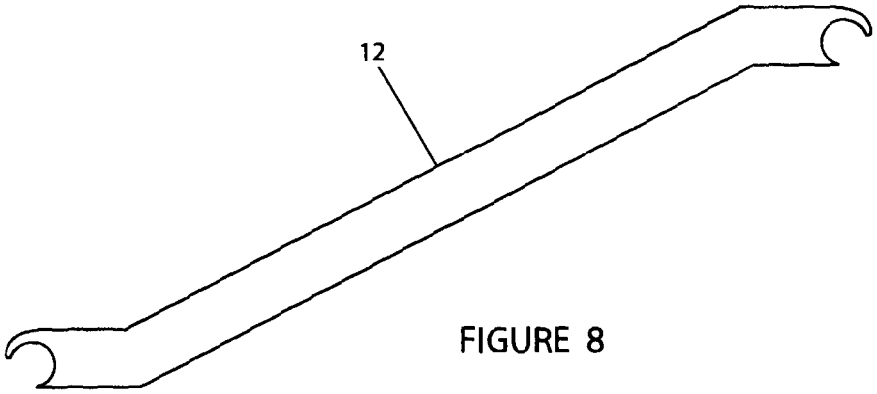
FIGS. 8 & 9—show respective side views of drawing tools according to other preferred embodiments of the present invention.
Figure 9:
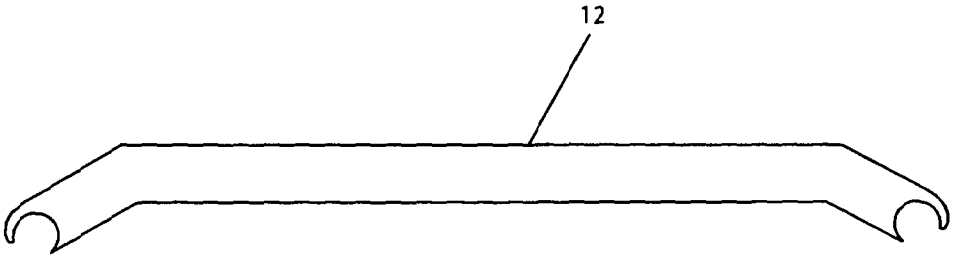

In addition, further effects can also be achieved by twisting or tilting the handle 12 of the tool 10 as it is dragged across the surface of the paper, as again this action can vary the pressure along the length of the lead 16, which can cause it to selectively The pressure differential along the graphite lead can yet further be controllably altered by varying the shape of the handle of the tool. Therefore, as shown in FIGS. 8 and 9, other examples of the tool can include either a 'kinked' or 'disjointed' handle or a substantially curved or arcuate handle. In each case, the artist is able to manipulate the handle while selectively applying pressure to a point or points along the length of the graphite lead.

Figure 10:
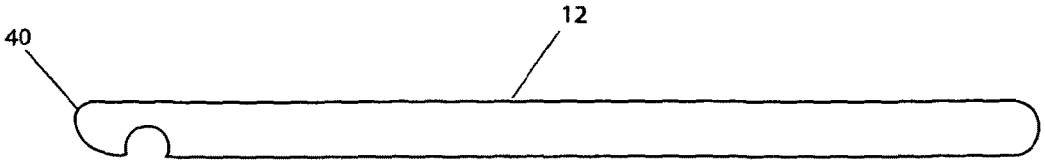
FIGS. 10 & 11—show respective side views of drawing tools according to further embodiments of the present invention.

In addition, the tool 10 may also be adapted to include means for further facilitating the raising and lowering of the forward tip of the handle (e.g. the end at which the first bore resides), to allow even more controlled manipulation of the tool, and in particular, to aid twisting and rotation of the tool relative to the drawing surface. Hence, as shown in FIG. 10, a protrusion 40 or projection on the tip of the handle 12 may be provided, which is disposed so as to come into contact with the drawing surface (not shown) when the handle 12 is angled near or close to the perpendicular to the drawing surface (e.g. the normal to the plane of the paper). In this way, the tool 10 may then be lifted away from the paper by using the protrusion 40 as a pivot point, enabling the artist to manipulate the tool with little or no significant effort. As a result, it is found that the tool is even easier to use and thus permits greater control over the degree of gradient shading.

Figure 11:
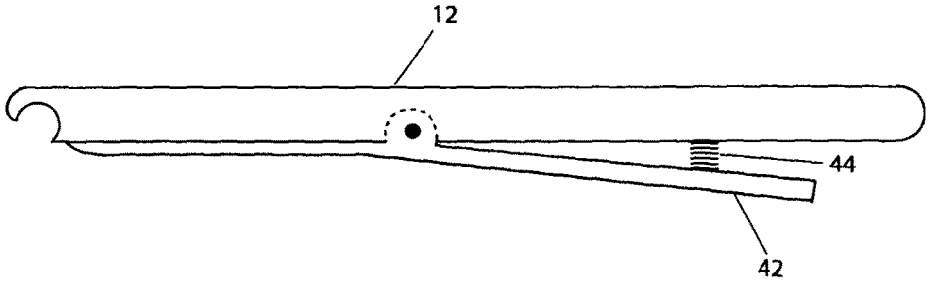
Figure 12:
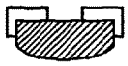
FIG. 12—shows an end view of a further embodiment of a drawing tool having a retaining means on the second end of the tool and preferably holding a disc shaped lead.
Figure 13:
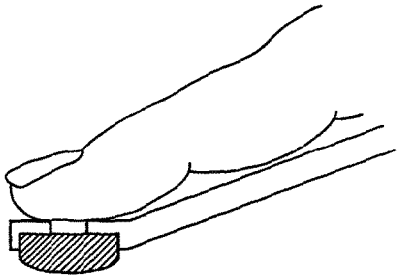
FIG. 13—shows a side view of the embodiment of FIG. 12, showing a bend in the handle and a preferred position for the user's finger.
Figure 14:
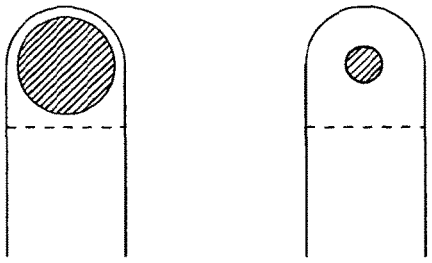
FIG. 14—shows top and bottom plan views of the embodiment of FIG. 12.
Figure 15:
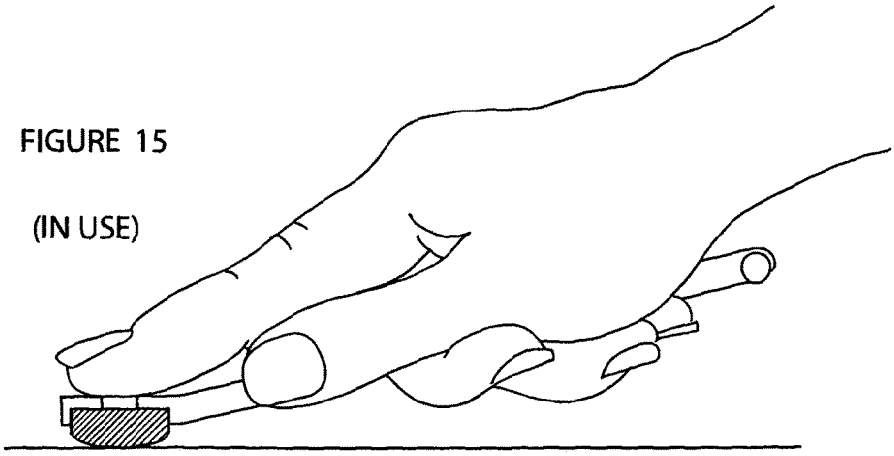
FIG. 15—shows the embodiment of FIG. 14 in an example use.

Referring to FIG. 11, a similar function may be achieved by the use of a pivoted lever 42 on the underside of the handle 12, which is biased by way of a spring 44. The lever 42 is operated by the pressure of the artist's fingers, which allows the lever to be compressed and released against the action of the spring 44. The distal end of the lever rests against the drawing surface (not shown) and hence manipulation of the lever 42 relative to the handle 12, alters the angle at which the forward tip of the tool 10 may be used. Therefore, again greater control of the tool can be achieved, while further facilitating lifting of the handle away from the paper to thereby controllably manipulate and twist the tool 10.

The preceding arrangements are consistent with any of the embodiments disclosed herein and hence may be used interchangeably with, or in addition to, any of the features described in relation to the foregoing examples, without limitation.

Thus, the drawing tool of the present invention provides artists and craftsman with significant advantages in terms of rendering complex and aesthetically pleasing shading effects, while remaining under the complete control of the artist and yet being easy to hold and use. In addition, the tool may be used by both left- and right-handed artists, without any loss of control or functionality.

The tool is found to be particularly well suited for 'life drawing', as discussed previously, since the tool is able to produce relatively large areas of gradient shading in a relatively short period of time, which hitherto has been a significant difficulty for artists who use the more traditional shading techniques, requiring the graphite to be held by hand. Hence, shading can be accomplished very quickly using this tool, and by altering the length of the lead that protrudes from either side of the bore, the width of the drawn gradient shading can be proportionately varied, such that a longer protruding length would give rise to a wider area of gradient shading, and vice versa.

Moreover, it is envisaged that the present drawing tool may be a valuable teaching aid for children and art students, as it enables them to render realistic gradients and shading much more easily and quickly than traditional drawing methods. With the current emphasis on easy techniques that produce "instant results", graphite/pencil drawing has been largely abandoned by schools and art colleges. However, the present drawing tool can itself produce instant results, and may help put graphite/pencil drawing back on the curricula, and may possibly assist many more people to discover the rewarding and valued art of drawing.

Although the drawing tool of the present invention is ideally suited for rendering a reliable and controllable gradient shading on a drawing surface, it will be recognized that one or more of the principles of the invention may extend to other artistic, and potentially non-artistic, applications, whereby a hand tool is required to controllable apply a layer of material to a surface such that a pressure differential can be exerted by a user to achieve different thicknesses across the layer, e.g. such as in gluing applications etc.

The above embodiments are described by way of example only. Many variations are possible without departing from the invention.

The invention claimed is:

1. A drawing tool for holding drawing material while drawing, said drawing tool comprising:

a handle;

a retaining means disposed on said handle, said retaining means defining a partially open bore having an axis substantially transverse to an axis of said handle, said bore being configured to releasably retain an elongate drawing material in an orientation substantially transverse to said axis of said handle so that a full length of a side of said drawing material protrudes from said partially open bore beyond a defined imaginary line joining outer extremities of tips of said retaining means defining an opening of said partially open bore allowing said full length of said drawing material to be applied to a surface; and a lever pivotably fitted to an underside of said handle, said lever being configured to be manipulated by a user to alter an angle at which a forward tip of said handle is used;

wherein said retaining means is configured to retain an elongate drawing material by way of a friction fit.

2. The drawing tool of claim 1, wherein said elongate drawing material is selected from the group consisting of a graphite lead, a pressed charcoal pencil, a natural charcoal stick, a chalk and a wax crayon.

3. The drawing tool of claim 1, wherein said bore is configured to receive and releasably grip the elongate drawing material within at least part of said bore.

4. The drawing tool of claim 3, wherein said retaining means is a first retaining means, and said handle further comprises a second retaining means disposed on said handle in spaced relation to said first retaining means.

5. The drawing tool of claim 4, wherein said second retaining means is configured to retain said second elongate drawing material by way of a friction fit.

6. The drawing tool of claim 4, wherein said second retaining means defines a partially open bore having an axis substantially transverse to said axis of said handle, said partially open bore of said second retaining means is configured so that a full length of a side of said drawing material protrudes from said partially open bore beyond a defined imaginary line joining outer extremities of tips of said second retaining means defining an opening of said partially open bore allowing said full length of said drawing material to be applied to a surface.

7. The drawing tool of claim 6, wherein said bore of said first retaining means is of a different size to said bore of said second retaining means.

8. The drawing tool of claim 6, wherein said axis of said bore of said first retaining means is substantially parallel to said axis of said bore of said second retaining means.

9. The drawing tool of claim 8, wherein said handle is elongate.

10. The drawing tool of claim 9, wherein said axis of said handle is defined by a longitudinal axis that runs along said elongate handle.

11. The drawing tool of claim 10, wherein said handle is planar, and wherein an orientation of the elongate drawing material is such that the elongate drawing material resides within a plane of said handle.

12. The drawing tool of claim 4, wherein said first retaining means is disposed on a first end portion of said handle, said second retaining means is disposed on a second end portion of said handle opposite said first retaining means, and wherein said first and second end portions of said handle each having an axis different than said axis of said handle.

13. The drawing tool of claim 4, wherein said bores of said first and second retaining means each define an opening down one side, said openings of said bores each being defined along a length of said handle such that a part of an outer wall of said bores are missing at a leading edge of said handle respectively.

14. The drawing tool of claim 13, wherein said part of said outer wall of said bores is one third of a circumference of said bore.

15. The drawing tool of claim 4, wherein said open bores of said first and second retaining means being angled away from each other.

16. The drawing tool of claim 1, wherein said lever comprises a distal end configured to rest against a drawing surface to alter the angle of said forward tip of said handle, and wherein said lever is biased by a spring that is contact with said lever and said handle.

17. The drawing tool of claim 16, wherein said lever includes a pivot connection between said distal end and a proximal end of said lever, said spring is located between said pivot connection and said proximal end, and said spring contacts said lever and said handle.

18. A drawing tool kit comprising:

a drawing tool comprising:

a handle;

a retaining means disposed on said handle, said retaining means defining a partially open bore having an axis substantially transverse to an axis of said handle, said bore being configured to releasably retain an elongate drawing material in an orientation substantially transverse to said axis of said handle; and a lever pivotably fitted to an underside of said handle, said lever being configured to be manipulated by a user to alter an angle at which a forward tip of said handle is used;

wherein said retaining means is configured to retain an elongate drawing material by way of a friction fit;

wherein said bore is configured to receive and releasably grip said elongate drawing material within at least part of said bore so that a full length of a side of said drawing material protrudes from said partially open bore beyond a defined imaginary line joining outer extremities of tips of said retaining means defining an opening of said partially open bore allowing said full length of said drawing material to be applied to a surface.

19. A method of using a drawing tool, said method comprising the steps of:

a) providing a drawing tool comprising a handle, a retaining means disposed on said handle, a lever pivotably fitted to an underside of said handle, said lever being manipulated by a user to alter an angle at which a forward tip of said handle is used, said retaining means defining a partially open bore having an axis substantially transverse to an axis of said handle;

b) introducing an elongate drawing material to be received in said bore so that said elongate drawing material is in an orientation substantially transverse to said axis of said handle so that a full length of a side of said drawing material protrudes from said partially open bore beyond a defined imaginary line joining outer extremities of tips of said retaining means defining an opening of said partially open bore allowing said full length of said drawing material to be applied to a surface;

c) retaining said elongate drawing material in said bore by way of a friction fit; and d) controlling said drawing tool by applying a finger pressure to an uppermost portion of a part of said handle that comprises said retaining means.

* * * * *